US011353189B2

(12) United States Patent
Hess

(10) Patent No.: US 11,353,189 B2
(45) Date of Patent: Jun. 7, 2022

(54) LIGHTING APPARATUS FOR VEHICLES AND MOUNTING METHOD

(71) Applicant: HELLA GmbH & Co. KGaA, Lippstadt (DE)

(72) Inventor: Rainer Hess, Zellerndorf (AT)

(73) Assignee: HELLA GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/490,174

(22) PCT Filed: Jan. 30, 2018

(86) PCT No.: PCT/DE2018/100071
§ 371 (c)(1),
(2) Date: Aug. 30, 2019

(87) PCT Pub. No.: WO2018/161988
PCT Pub. Date: Sep. 13, 2018

(65) Prior Publication Data

US 2020/0003387 A1 Jan. 2, 2020

(30) Foreign Application Priority Data

Mar. 8, 2017 (DE) ..... 10 2017 104 841.3

(51) Int. Cl.
*F21S 41/39* (2018.01)
*F21S 45/49* (2018.01)
(Continued)

(52) U.S. Cl.
CPC ..... *F21S 41/39* (2018.01); *F21S 41/148* (2018.01); *F21S 41/192* (2018.01); *F21S 45/47* (2018.01);
(Continued)

(58) Field of Classification Search
CPC ..... F21S 41/148; F21S 41/192; F21S 41/39
See application file for complete search history.

(56) References Cited

U.S. PATENT DOCUMENTS 10,107,470 B2 10/2018 Mornet
2008/0062709 A1* 3/2008 Mochizuki ..... F21S 41/148 362/539
(Continued)

FOREIGN PATENT DOCUMENTS

DE 1020121007432 A1 5/2014
DE 102013102835 A1 9/2014
(Continued)

OTHER PUBLICATIONS

English translation of the International Preliminary Report on Patentability dated Sep. 19, 2019, in International Application No. PCT/DE2018/100071.
(Continued)

*Primary Examiner* — Zheng Song
(74) *Attorney, Agent, or Firm* — Patent Central LLC; Stephan A. Pendorf

(57) ABSTRACT

A lighting apparatus for vehicles, including: a light-source device containing a light source and a light source carrier; an optical device for generating a predefined light distribution; and a cooling device for the light source; the light source being fastened relative to the optical device in a target calibration position, and the light source carrier being fastened in the target calibration position between a contact surface of the optical device and a contact surface of the cooling device.

9 Claims, 3 Drawing Sheets

Figure 1:
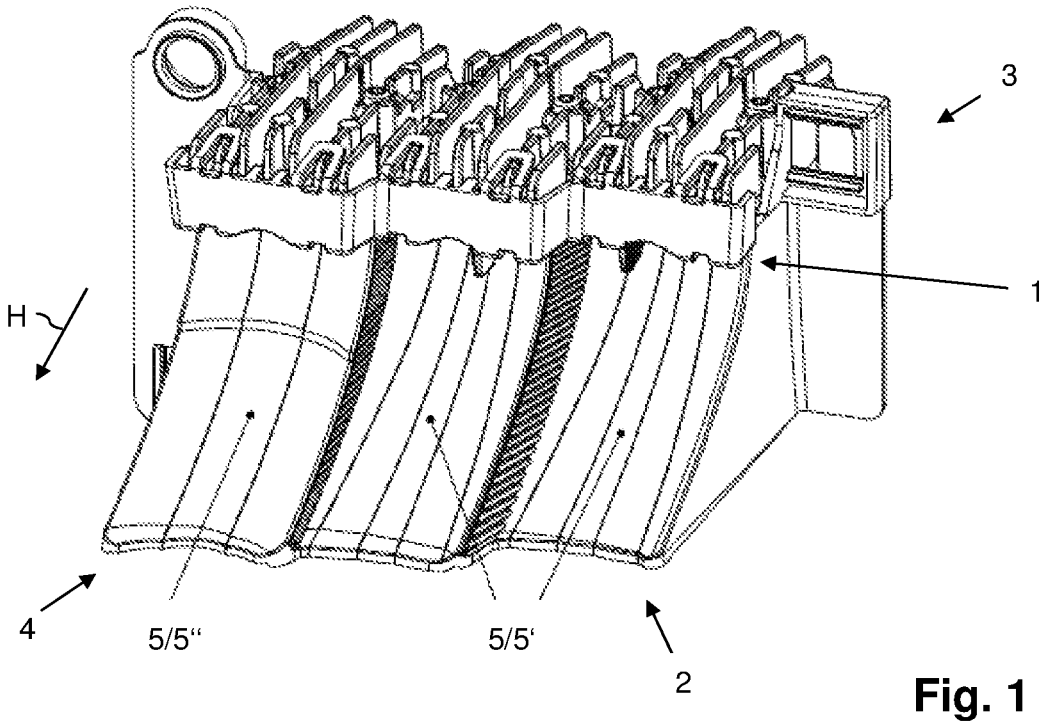

(51) Int. Cl.

| | |
|---|---|
| ***F21S 41/148*** | (2018.01) |
| ***F21S 41/19*** | (2018.01) |
| ***F21S 45/47*** | (2018.01) |
| ***F21V 7/06*** | (2006.01) |
| ***F21V 17/12*** | (2006.01) |
| ***F21V 19/00*** | (2006.01) |
| *F21Y 115/10* | (2016.01) |

(52) U.S. Cl.
CPC ..... *F21S 45/49* (2018.01); *F21V 7/06* (2013.01); *F21V 17/12* (2013.01); *F21V 19/0055* (2013.01); *F21Y 2115/10* (2016.08)

(56) References Cited

U.S. PATENT DOCUMENTS

2011/0273899 A1* 11/2011 Ota ..... B62J 6/04 362/518
2013/0070469 A1* 3/2013 Sugie ..... F21S 45/48 362/516
2014/0286035 A1 9/2014 Lebrato-Rastojo et al.
2014/0376232 A1* 12/2014 Behr ..... F21S 41/19 362/294
2015/0062948 A1* 3/2015 Otsubo ..... F21S 41/148 362/518
2015/0198325 A1 7/2015 Muegge et al.
2015/0241011 A1* 8/2015 Bauer ..... F21S 41/336 362/514
2015/0267886 A1* 9/2015 Caban ..... F21S 41/147 362/516
2015/0377439 A1* 12/2015 Madelaine ..... F21S 41/29 362/516
2016/0131324 A1* 5/2016 Windgruber ..... F21S 45/47 362/509
2016/0312971 A1* 10/2016 Tsukada ..... B60Q 1/068
2016/0356447 A1* 12/2016 Yamamoto ..... F21S 41/147
2017/0030547 A1* 2/2017 Yasuda ..... F21S 45/10
2017/0211768 A1* 7/2017 Mornet ..... F21S 41/148
2018/0112844 A1* 4/2018 Bowles ..... F21S 41/39
2018/0128444 A1* 5/2018 Suemitsu ..... F21S 41/336
2019/0041024 A1* 2/2019 Yamaguchi ..... F21S 41/321
2019/0271596 A1* 9/2019 Aoki ..... F21S 41/148
2019/0368707 A1* 12/2019 Kanamori ..... F21V 23/007
2020/0240606 A1* 7/2020 Sato ..... F21S 41/337

FOREIGN PATENT DOCUMENTS

EP 2921772 A1 9/2015
EP 2966343 A1 1/2016
EP 3021040 A1 5/2016
EP 3104074 A1 12/2016
FR 3022980 A1 1/2016
JP 2015149157 A 8/2015
JP 2018137125 A * 8/2018 ..... F21S 41/00
WO 2014190368 A1 12/2014

OTHER PUBLICATIONS

International Search Report dated May 17, 2018, in International Application No. PCT/DE2018/100071.

* cited by examiner

LIGHTING APPARATUS FOR VEHICLES AND MOUNTING METHOD

The invention relates to a lighting apparatus for vehicles, with a light source device including a light source and a light source carrier, with an optics device for generating a predetermined light distribution and with a cooling device for the light source, wherein the light source is fastened in a reference aligning position relative to the optics device.

The invention further relates to a method for mounting a lighting apparatus, wherein a light source device including a light source and a light source carrier is brought into and fixed in a reference aligning position relative to an optics device.

A lighting apparatus for vehicles comprising a light source device, an optics device and a cooling device is known from DE 10 2012 107 432 A1. The light source device comprises a planar light source carrier (board) on which a light source is fixed. The light source carrier is connected flat against the cooling device, for example, by gluing or screwing, to form a light source-cooling assembly. This assembly is then connected in a drawer-like manner via a guide to the optics device which is formed as a reflector. A disadvantage of the known lighting apparatus consists in that there is a relatively long tolerance chain from the light source carrier through the cooling device to the optics device, which fosters the occurrence of positional inaccuracies of the light source relative to the optics device.

A lighting apparatus for vehicles with a light source device, an optics device and a cooling device is known from DE 10 2013 102 835 A1. A light source carrier of the light source device is mounted on an abutment surface of a first leg of the cooling body device. Another leg of the cooling body device is connected to a rear side of a reflector of the optics device. This lighting apparatus also has a relatively long tolerance chain between light source carrier and reflector.

Therefore, it is the object of the present invention to provide a lighting apparatus for vehicles and a mounting method which increases the positional accuracy of a light source device relative to the optics device during mounting in a simple manner.

This object is met by the lighting apparatus according to the invention in connection with the preamble of Claim 1, characterized in that the light source carrier is fastened in the reference aligning position between an abutment surface of the optics device and an abutment surface of the cooling device.

The particular advantage of the invention consists in that an enhanced positional accuracy of a light source device relative to an optics device is achieved by reducing a tolerance chain. According to the invention, a light source carrier is fastened in a reference aligning position between an abutment surface of the optics device and an abutment surface of the cooling device. Fastening of the light source carrier can be preceded by orientation or alignment relative to the optics device. Tolerances of a cooling body device need not be taken into account. A further advantage results from the fact that when the light source device is fastened to the optics device the cooling device is also fixed simultaneously. Mounting effort can advantageously be reduced in this way.

According to a preferred embodiment form of the invention, the light source carrier is held between the cooling device and the optics device by a screw connection. This results in a secure mounting and disassembly of the light source device.

According to a further development of the invention, the light source carrier is positioned at the abutment surface of the optics device via at least two bearing points, wherein the bearing points are arranged to be distributed over the abutment surface of the optics device. A lug cooperating with bore holes of the light source carrier protrudes in each instance from the abutment surface of the optics device into the bearing points. A bore hole of the light source carrier is preferably formed as a round hole at a first bearing point such that the light source carrier is fixed at this first bearing point in a plane of extent of the abutment surface. Beyond this, a further bore hole of the light source carrier is formed as an elongated hole in a second bearing point such that the light source carrier is displaceable at the second bearing point in a predetermined direction extending perpendicular to the plane of extent of the abutment surface. The preferred aligning direction preferably coincides with a principal emitting direction of the lighting apparatus. In this way, the position of the light source in the aligning direction, or in the principal emitting direction, can advantageously be adjusted relative to the optics device in a simple manner. The light source is fixed in the reference aligning position only by means of subsequent tightening of the fastening screws which extend through the bore holes and engage in the respective lugs.

According to a further development of the invention, the lugs of the optics device have an internal thread so that a shaft of a fastening screw can be brought into threaded engagement with the respective lug. A secure connection of the cooling device to the optics device can be provided in this way accompanied by alignment of the light source device.

According to a further development of the invention, the cooling device has a receiving recess for the respective lugs of the optics device, and an inside diameter of the receiving recess is larger than an outside diameter of the lug. In this way, the optics device can advantageously be freely supported relative to the cooling device in the plane of extent. Tolerances of the cooling device can be compensated in this way.

According to a further development of the invention, a plurality of reflectors of the optics device are connected to one another in one piece, a separate light source device and a separate cooling device being associated with each reflector. An additional orientation of the reflectors with respect to one another for generating one or more light distributions can advantageously be avoided in this way.

In order to meet the object, the invention is characterized in connection with the preamble of Claim 9 in that, in a first step, the light source carrier is positioned at an abutment surface of the optics device; in that, in a second step, the light source carrier is moved relative to the optics device in a plane of extent having the abutment surface into a reference aligning position for orientation of the light source with respect to the optics device; and in that, lastly, the light source carrier is clamped between the abutment surface of the optics device and an abutment surface of the cooling device.

The method according to the invention allows an accurately positioned fastening of a light source device with respect to an optics device. A light source carrier of the light source device is positioned relative to the optics device. After alignment of the light source carrier relative to the optics device, a clamping of the light source carrier between an abutment surface of the optics device and an abutment surface of a cooling device is carried out. According to the method according to the invention, a positioning of the light source carrier and of the light source directly at an abutment surface of the optics device is carried out in a first step. The light source carrier is preferably positioned vertically (z-direction) in that the light source carrier bears against the abutment surface of the optics device. In a second step, an orientation and alignment of the light source carrier relative to the optics device is carried out by displacing the light source carrier in the plane of extent, preferably in aligning direction. After alignment, the light source carrier is fixed relative to the optics device in a third step, wherein the cooling device is fixed to the optics device in addition or simultaneously. A simple alignment and fixing of component parts of the lighting apparatus can advantageously be carried out in this way.

According to a preferred further development of the method according to the invention, the positioning of the light source carrier is carried out at least two bearing points, and the light source carrier is fixedly positioned at a first bearing point in the plane of extent of the abutment surface and is positioned so as to be displaceable in an aligning direction in a second bearing point. In a further step, the alignment can then be carried out by displacing the light source carrier relative to the optics device in aligning direction. The alignment is accordingly limited essentially to a single direction, namely, preferably to an aligning direction which is directed in the principal emitting direction of the lighting apparatus. The reason for this is that the most serious errors can occur during the basic adjustment of the lighting apparatus.

Figure 2:
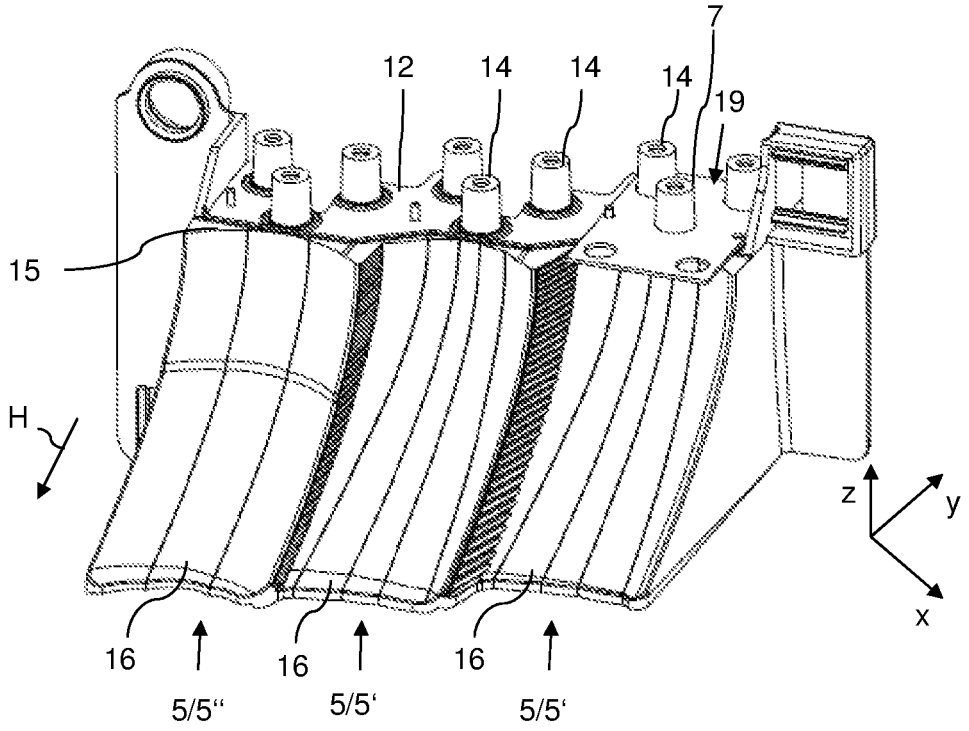
Figure 3:
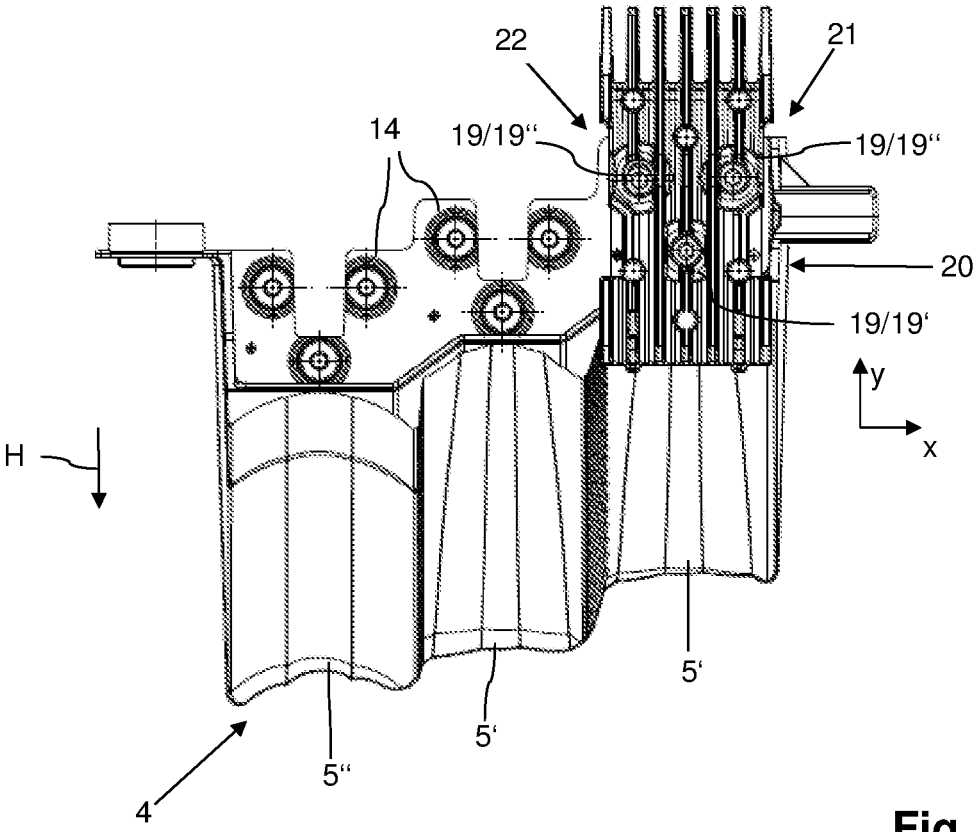
Figure 4:
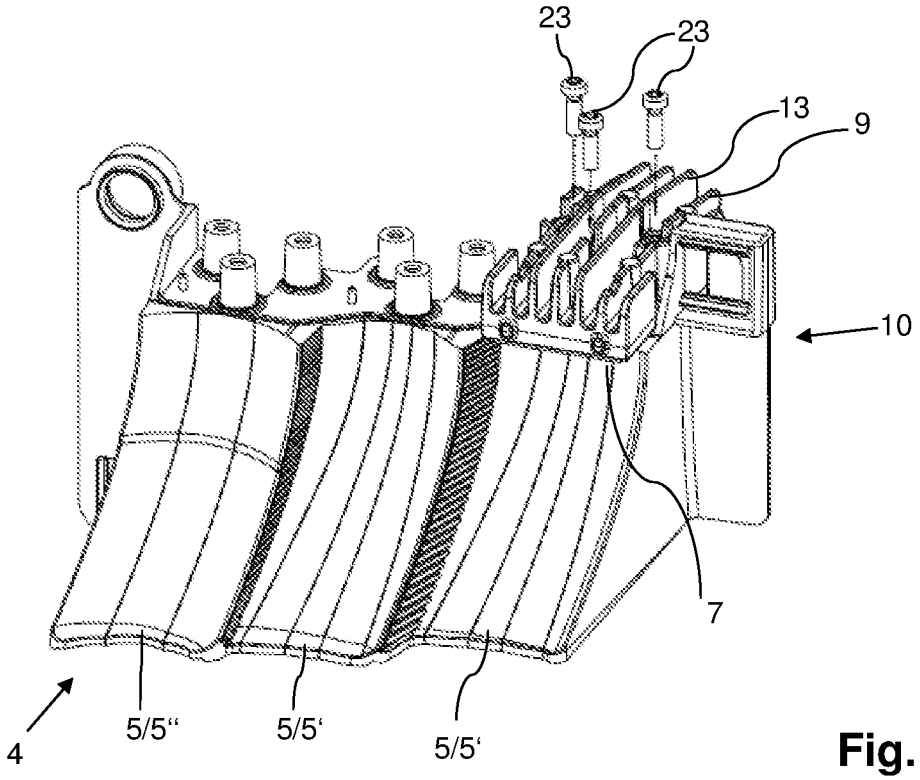
Figure 5:
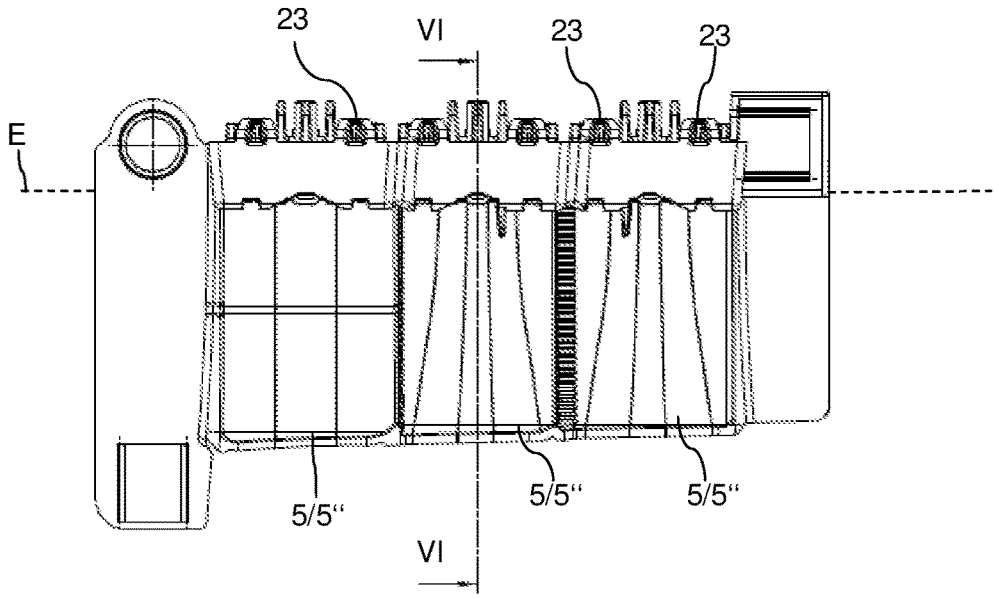

An embodiment example of the invention is described in more detail in the following with reference to the drawings:

The drawings show:

FIG. 1 a perspective front view of an assembly consisting of a light source device, an optics device and a cooling device, wherein the assembly is installed in a housing, not shown, of a lighting apparatus;

FIG. 2 an oblique top view of a reflector assembly after positioning of a light source carrier of the light source device on an upper side of a reflector of the reflector assembly;

FIG. 3 top view of the reflector assembly according to FIG. 2;

FIG. 4 a view of the reflector assembly immediately prior to fixing a cooling device to a reflector of the reflector assembly;

FIG. 5 a front view of the assembly in the mounted state and

Figure 6:
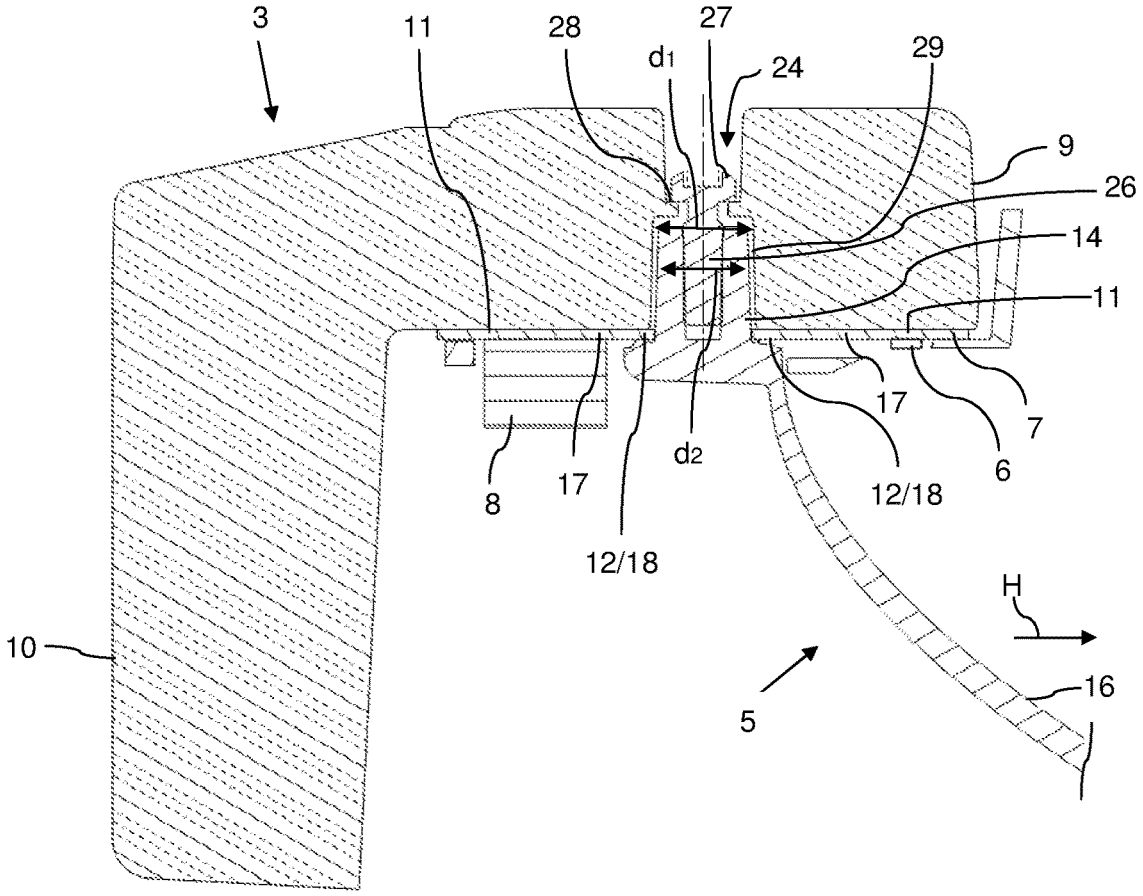

FIG. 6 a vertical section through section line VI-VI in FIG. 5.

A lighting apparatus can be used as headlight in the front area of a vehicle, for example, of an agricultural vehicle (agricultural machine), to generate a predetermined light distribution, for example, of a work light, daytime running lamp, low beams and high beams. Alternatively, the lighting apparatus can also be used in a rear area of a vehicle or at another location.

FIG. 1 shows an assembly for generating a low beam light distribution and a high beam light distribution. This assembly is installed in a housing, not shown, which is provided over an opening that is covered by a transparent closing plate.

The lighting apparatus substantially has a light source device 1, an optics device 2 for generating the predetermined light distribution (low beam, high beam) and a cooling device 3 for cooling or dissipating heat from the light source device 1.

The optics device 2 comprises a reflector assembly 4 with a quantity of reflectors 5, three in the present embodiment example, which are connected to one another in one piece. In FIG. 1, a first and a second reflector 5' are used for low beam light distribution and a third reflector 5" is used for high beam light distribution. Separate light source devices 1 and cooling devices 3 are associated with reflectors 5, 5', 5", respectively. In the following, the mounting of light source device 1 at the first reflector 5' (the reflector 5' on the right-hand side viewed from the front) is described by way of example.

The light source device 1 comprises a quantity of light sources 6 (LED light source) which are fixed to a light source carrier 7. In the present embodiment example, only one light source 6 is provided. In addition, control electronics 8 are mounted on the light source carrier 7. The light source carrier 7 is preferably constructed as a printed circuit board, preferably a rigid, planar printed circuit board.

The cooling device 3 comprises an L-shaped cooling body with a first leg 9 and with a second leg 10 preferably extending at right angles to the first leg 9. The first leg 9 extends substantially in horizontal direction, while the second leg 10 extends in vertical direction. The second leg 10 preferably contacts a rear side of the reflectors 5. The first leg 9 is supported on an upper side 12 of the reflector 5. In the mounted state, the light source carrier 7 is arranged between an upper side 12 of the reflector 5 and an abutment surface 11 of the cooling body 3. The abutment surface 11 of the cooling body 3 accordingly forms a contact surface which bears flat against the light source carrier 7. Cooling ribs 13 for dissipating heat into the environment are provided on a side of the first leg 9 remote of the light source carrier 7.

As is apparent from FIG. 2, the reflector 5 has a quantity of lugs 14 at its upper side 12 which serve to fix and align the light source carrier 7. The lugs 14 are arranged to be distributed on the upper side 12 and protrude perpendicularly from the upper side 12. The lugs 14 have an internal thread in each instance.

Reflector surfaces 16 of the reflectors 5 extend downward in a parabolic arc or as freely shaped surfaces from a front outer edge 15 of the upper side 12. As can be seen from FIG. 6, the LED light source 6 is arranged to be directed downward so that the emitted light is deflected forward in principal emitting direction H from the reflector surface 16.

For mounting, the light source carrier 7 fitted with the light source 6 and control electronics 8 is placed on the upper side 12 of the reflector 5 in a first step. The flat side 17 of the light source carrier 7 having the LED light source 6 bears flat against an abutment surface 18 of the reflector 5. The light source carrier 7 has bore holes 19 corresponding to the lugs 14 so that the light source carrier 7 is positioned flat in a plane of extent E of the reflector 5 receiving the upper side 12. The lugs 14 form bearing points for the light source carrier 7 in each instance. In the present case, three lugs 14 and three bearing points are provided such that the light source carrier 7 lies flat in the plane of abutment surface 18 after being placed on the upper side 12 of the reflector 5. The light source carrier 7 preferably extends in a horizontal plane of extent E.

A first bore hole 19' is formed as a round hole and two second bore holes 19" are formed as elongated holes so that the light source carrier 7 can be oriented and aligned in an aligning direction, in principal emitting direction H (y-direction) in the present embodiment example. The light source carrier 7 is fixedly positioned in plane of extent E at a first bearing point 20 by means of the round hole 19'. There is provided at a second bearing point 21 and a third bearing point 22 by means of the elongated holes 19" whose longitudinal direction faces in principal emitting direction H (in y-direction) so that the light source carrier is displaceable relative to the reflector 5 in y-direction at this second bearing point 21 and third bearing point 22.

After moving or displacing the light source carrier 7 relative to the reflector 5 into a reference aligning position in which the light source 6 is located in a desired defined position with respect to the reflector surface 5', this reference position is fixed by means of fastening screws 23. These fastening screws 23 extend with their respective shaft 26 which is provided with an external thread through a bore hole 24 of the cooling body 3 into the lugs 14 to form a threaded engagement therewith. A head 27 of the fastening screw 23 presses on an annular surface 28 of the cooling body 3. By tightening the fastening screw 23, the light source carrier 7 is clamped and fixed between the abutment surface of the cooling body 3 and the abutment surface of the reflector 5. A receiving recess 29 of the cooling body 3 having an inside diameter $d_1$ adjoins on a side of the bore hole 24 facing the reflector 5. This inside diameter $d_1$ is greater than an outside diameter $d_2$ of the lug 14 so that the reflector 5 is freely supported relative to the cooling body 3 in the plane of extent E. Naturally, the bore hole 24 is larger than an outside diameter of the shaft 26 so that a compensating movement is possible in the plane of extent E of the cooling body 3 relative to the reflector 5. Such a compensating movement of the cooling body 5 relative to the reflector 5 is preferably carried out before moving the light source carrier 7 into its reference aligning position relative to the reflector 5. When the fastening screws 23 are tightened, both the light source carrier 7 and the cooling body 3 are fixed to the reflector 5. The assembly formed in this way can then be fixed in the housing of the lighting apparatus.

The invention claimed is:

1. A lighting apparatus for vehicles, with a light source device (1) including a light source (6) and a light source carrier (7), an optics device (2) for generating a predetermined light distribution, having an abutment surface (18) and lugs (14) projecting from the abutment surface (18), and a cooling device (3) for the light source (6), wherein the light source (6) is fastened in a reference aligning position relative to the optics device (2), wherein the light source carrier (7) is adapted to being fastened, in the reference aligning position of the light source (6), between the abutment surface (18) of the optics device (2) and an abutment surface (11) of the cooling device (3), contacting both the abutment surface of the optics device (2) and the abutment surface of the cooling device (3), via at least first and second bearing points provided on the abutment surface of the optics device (2), wherein the first bearing point is adapted to fix the light source carrier (7) in a plane of extent (E) of the abutment surface (18), and the second bearing point is adapted to allow the light source carrier (7) to be displaceable in a direction extending perpendicular to the plane of extent (E) of the abutment surface (18), wherein the cooling device (3) has receiving recesses (29) for receiving the respective lugs (14) of the optics device (2), wherein an inside diameter ($d_1$) of the receiving recess (29) is larger than an outside diameter ($d_2$) of the respective lug (14), and wherein the cooling device (3) is fastened to the lugs (14) of the optics device (5) by fastening screws (23) in threaded engagement in respective lugs (14).

2. The lighting apparatus according to claim 1, wherein the light source carrier (7) is planar and has at least two bore holes (19, 19', 19") in which respective lugs (14) projecting from the abutment surface (18) of the optics device (2) engages, wherein at least one bore hole (19) of said at least two bore holes (19, 19', 19") is formed at a first bearing point (20) as a round hole (19') adapted to one of the lugs (14) of the optics device (2) such that the light source carrier (7) is fixed at the first bearing point (20) in the plane of extent (E) of the abutment surface, and wherein at least one further bore hole (19) of said at least two bore holes (19, 19', 19") is formed as an elongated hole (19") at a second bearing point (21, 22) such that the light source carrier (7) is displaceably adjustable at the second bearing point (21, 22) in a predetermined aligning direction.

3. The lighting apparatus according to claim 2, wherein said predetermined aligning direction is a principal emitting direction H.

4. The lighting apparatus according to claim 1, wherein the light source carrier (7) is fastened to the optics device (2) by a screw connection.

5. The lighting apparatus according to claim 1, wherein the light source carrier (7) is positioned via at least two bearing points (20, 21, 22) which are arranged to be distributed in a plane of extent (E) receiving the abutment surface (18) of the optics device (2), wherein the light source carrier (7) is planar and has at least two bore holes (19, 19', 19") in which respective lugs (14) projecting from the abutment surface (18) of the optics device (2) engages.

6. The lighting apparatus according to claim 1, wherein the lugs (14) of the optics device (5) have an internal thread, wherein the cooling device (3) has bore holes (24) aligned with the lugs (14) of the optics device (5) at the bearing points (20, 21, 22) for the partial engagement of fastening screws (23) in the lugs (14), wherein a shaft (26) of the fastening screws (23) is in threaded engagement with the respective lug (14).

7. The lighting apparatus according to claim 1, wherein the abutment surface (18) of the optics device (5) is formed by an upper side (12) of a reflector (5), and a quantity of reflector surfaces (16) extends downward in an arc-shaped manner from the outer edge (15) of the reflector (5).

8. The lighting apparatus according to claim 1, wherein a plurality of reflectors (5, 5', 5") are connected to one another in one piece, wherein a separate light source carrier (7) and a separate cooling device (3) are connected to each reflector (5', 5").

9. A lighting apparatus for vehicles, with a light source device (1) including a light source (6) carried on a printed circuit board light source carrier (7), an optics device (2) for generating a predetermined light distribution, having an abutment surface (18) and lugs (14) projecting from the abutment surface (18), and a cooling device (3) for the light source (6), wherein the light source (6) is fastened in a reference aligning position relative to the optics device (2), wherein the light source carrier (7) is fastened, in the reference aligning position of the light source (6), between the abutment surface (18) of the optics device (2) and an abutment surface (11) of the cooling device (3), via at least first and second bearing points provided on the abutment surface of the optics device (2), wherein the first bearing point is adapted to fix the light source carrier (7) in a plane of extent (E) of the abutment surface (18), and the second bearing point is adapted to allow the light source carrier (7) to be displaceable in a direction extending perpendicular to the plane of extent (E) of the abutment surface (18), wherein the cooling device (3) has receiving recesses (29) for receiving the respective lugs (14) of the optics device (2), wherein an inside diameter ($d_1$) of the receiving recess (29) is larger than an outside diameter ($d_2$) of the respective lug (14), and wherein the cooling device (3) is fastened to the lugs (14) of the optics device (5) by fastening screws (23) in threaded engagement in respective lugs (14).

* * * * *